US007806313B2

(12) United States Patent
Philips

(10) Patent No.: US 7,806,313 B2
(45) Date of Patent: Oct. 5, 2010

(54) SHIPPING AND DISPLAY CONTAINER AND ASSOCIATED CONTAINER BLANK

(75) Inventor: Nicholas A Philips, Sugar Grove, IL (US)

(73) Assignee: International Paper Co., Memphis, TN (US)

( * ) Notice: Subject to any disclaimer, the term of this patent is extended or adjusted under 35 U.S.C. 154(b) by 0 days.

(21) Appl. No.: 11/694,442

(22) Filed: Mar. 30, 2007

(65) Prior Publication Data

US 2008/0237320 A1 Oct. 2, 2008

(51) Int. Cl.
*B65D 5/28* (2006.01)
*B65D 5/468* (2006.01)

(52) U.S. Cl. ..... 229/109; 229/117.16; 229/162.6

(58) Field of Classification Search ..... 229/109, 229/162.1, 120, 117.16, 162.6, 164, 193
See application file for complete search history.

(56) References Cited

U.S. PATENT DOCUMENTS 1,892,715 A * 1/1933 Wellman ..... 229/109
2,499,780 A * 3/1950 Rottman ..... 229/180
2,544,283 A * 3/1951 Snyder ..... 229/117.16
2,776,083 A * 1/1957 Sam Derman ..... 229/122
2,967,655 A * 1/1961 Seger, Jr. ..... 229/109
3,533,547 A * 10/1970 Houston ..... 229/125.19
4,154,388 A * 5/1979 Hall ..... 229/193
4,185,764 A * 1/1980 Cote ..... 229/117.03
4,418,861 A * 12/1983 McFarland et al. ..... 229/110
4,470,540 A * 9/1984 Koltz ..... 229/109
4,600,142 A * 7/1986 Quaintance ..... 229/143
4,676,429 A * 6/1987 Crowe et al. ..... 229/109
4,792,084 A * 12/1988 Dreeszen ..... 229/109
4,828,929 A * 5/1989 Pierson ..... 229/109
4,953,779 A * 9/1990 Densen ..... 229/193
5,139,196 A * 8/1992 Fry et al. ..... 229/157
5,419,486 A * 5/1995 Bennett et al. ..... 229/109
5,752,648 A * 5/1998 Quaintance ..... 229/109
7,090,115 B2 * 8/2006 Pierce ..... 229/109
2006/0038000 A1 * 2/2006 Sheffer ..... 229/164

* cited by examiner

*Primary Examiner*—Gary E Elkins

(57) ABSTRACT

The present invention includes a blank and container formed from cellulose-based materials configured to form an octagonal shaped display and/or shipping container. The container includes a multiple sidewall thickness throughout a majority of the various sidewalls to add to stacking strength and stability of the container. Also in certain embodiments, the container includes top panels closing off the top portion of the container. Additionally in another embodiment, the container does not have any top panels at all. Likewise, the container may have solid sidewalls, or the container may have viewing and access cutouts formed in the sidewalls.

14 Claims, 11 Drawing Sheets

SHIPPING AND DISPLAY CONTAINER AND ASSOCIATED CONTAINER BLANK

FIELD OF THE INVENTION

This invention relates generally to blanks and the resulting containers and more specifically to blanks and containers for forming shipping and/or display containers.

BRIEF DESCRIPTION OF THE DRAWINGS

Various embodiments of the present invention are best understood from the following detailed description when read in connection with the accompanying drawings. It is emphasized that, according to common practice, various features of the drawings are not to scale. On the contrary, the dimensions of the various features are arbitrarily expanded or reduced for clarity. Included are the drawings for the following figures.

DETAILED DESCRIPTION OF THE DRAWINGS

Figure 1:
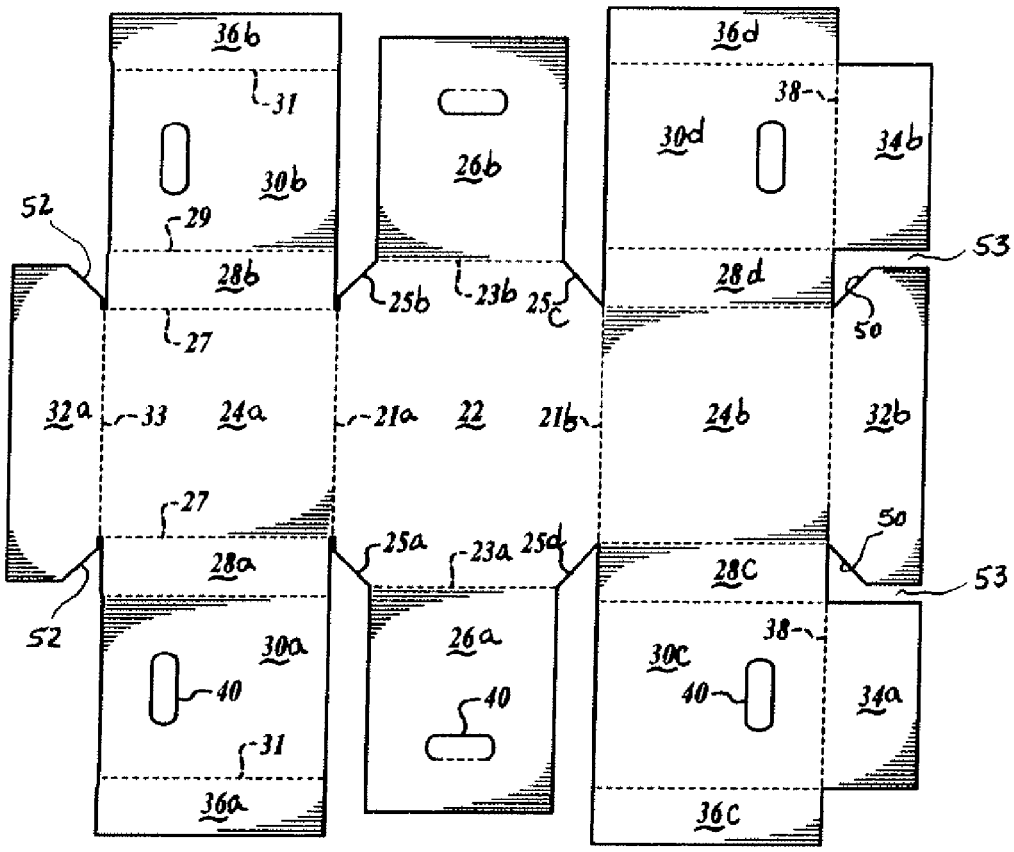
FIG. 1 is a plan view of a container blank formed in accordance to an aspect of the present invention.

The present invention will now be described with reference to the accompanying drawings. The present invention is directed to a blank 20 and container 42 that utilizes an octagonal shape and selective regions of multi-wall thickness to impart strength and stability to the final container 42. One suitable embodiment of the blank 20 and container 42, constructed in accordance with aspects of the present invention, is illustrated in FIGS. 1 through 8. Another suitable embodiment is depicted in FIGS. 9 through 16. A further embodiment is depicted in FIGS. 17 through 21. Specific details of the blank 20 and the resulting container 42 are described in more particularity below.

FIG. 1 depicts a blank 20 used to form container 42 that is generally configured to be a shipping box having minor flaps. The blank 20 is typically constructed from a single piece of formable material such as, without limitation, sheets of cellulose-based materials formed from cellulose materials such as wood pulp, straw, cotton, bagasse or the like. Cellulose-based materials used in the present invention come in many forms, such as fiberboard, containerboard, corrugated containerboard and paperboard. The blank 20 is cut, scored, perforated or otherwise formed into a plurality of panels that, when assembled, form container 42. In all FIGURES, like numbers indicate like parts. Additionally, cut lines are shown as solid lines, score lines as dashed lines, and lines of perforation as broken lines. For the purposes of further description herein, the downward direction is defined as the direction perpendicular to the bottom panel 22 that corresponds to an outer surface of the bottom panel 22 when container 42 has been erected. The upward direction is defined as the direction perpendicular to the bottom panel 22 that corresponds to the inner surface of the bottom panel 22 when container 42 has been erected.

The blank 20 includes a bottom panel 22 that is bounded by opposed fold lines 21 and opposed fold lines 23. Additionally, the bottom panel 22 is defined by cut lines 25 which extend between the respective fold lines 21 and 23 forming truncated corner regions. The fold lines 21 and 23 and cut lines 25 give the bottom panel 22 an overall octagonal shape.

Connected with the bottom panel 22 along fold line 21 is a first side panel 24. Connected with the first side panel 24, opposite the bottom panel 22, is a first top panel 32. The first top panel 32 is connected with the first side panel 24 along a fold line 33, which is substantially parallel to fold line 21.

Connected with the first side panel 24, along a fold line 27, is a third side panel 28. Fold line 27 is substantially normal to fold lines 21 and 23, respectively. Connected with the third side panel 28, along a fold line 29, is a fourth side panel 30. A fifth side panel 36 is connected with the forth side panel 30 along fold line 31. Fold lines 27, 29 and 31 all lie substantially parallel to one another and all are substantially normal to fold lines 21 and 23.

Connected with the bottom panel 22 along a fold line 23 are second side panels 26. In one particular embodiment, the second side panels 26 include cut-outs 40. However, it will be appreciated that cutouts 40 are optional and need not be present in certain embodiments.

Figure 2:
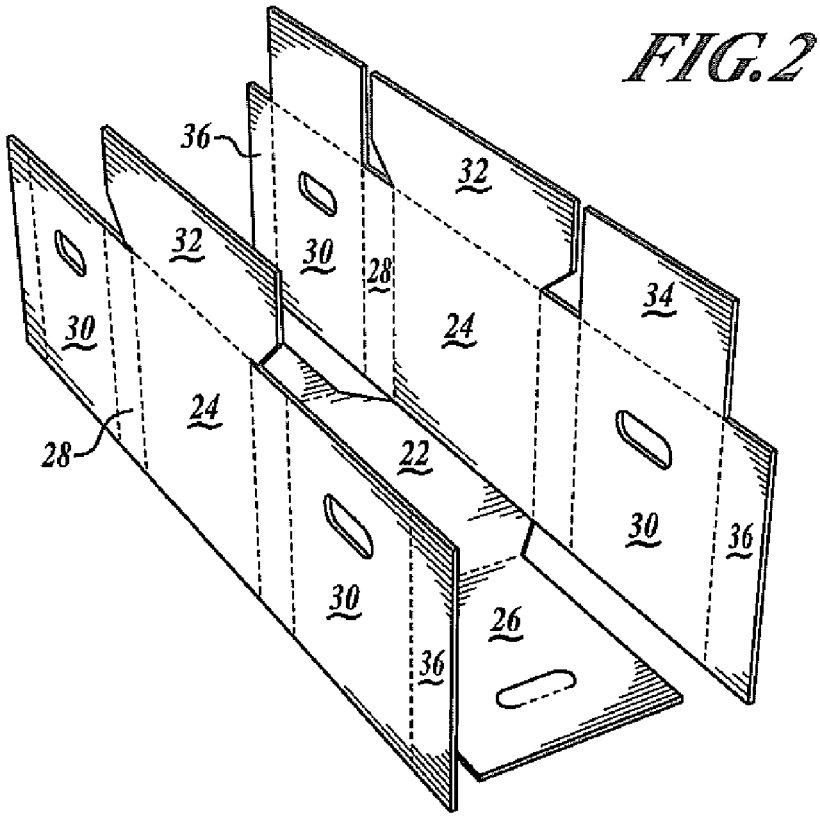
FIG. 2 is a perspective view of a partially assembled container based on the blank of FIG. 1.
Figure 3:
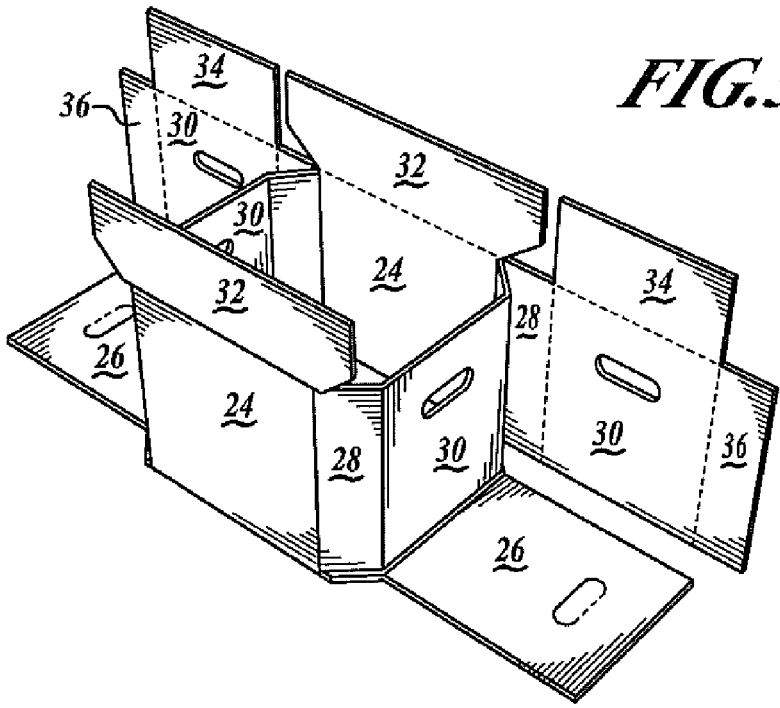
FIG. 3 is another, more fully assembled container based upon the blank of FIG. 1.

FIGS. 2 through 8 depict an erection sequence for the container 42 from the blank 20 depicted in FIG. 1. Specifically, the first side panels 24 are folded upwardly approximately 90 degrees along fold lines 21, which brings the first side panel 24, third side panel 28, fourth side panel 30 and fifth side panel 36 in a plane that is substantially perpendicular to the bottom panel 22. This arrangement is best seen in FIG. 2. The erection process continues by folding the third side panel 28, the fourth side panel 30 and fifth side panel 36 around respective fold lines 27, 29 and 31, such that these panels align with the perimeter defined by fold lines 21 and 23 and cut lines 25.

Figure 4:
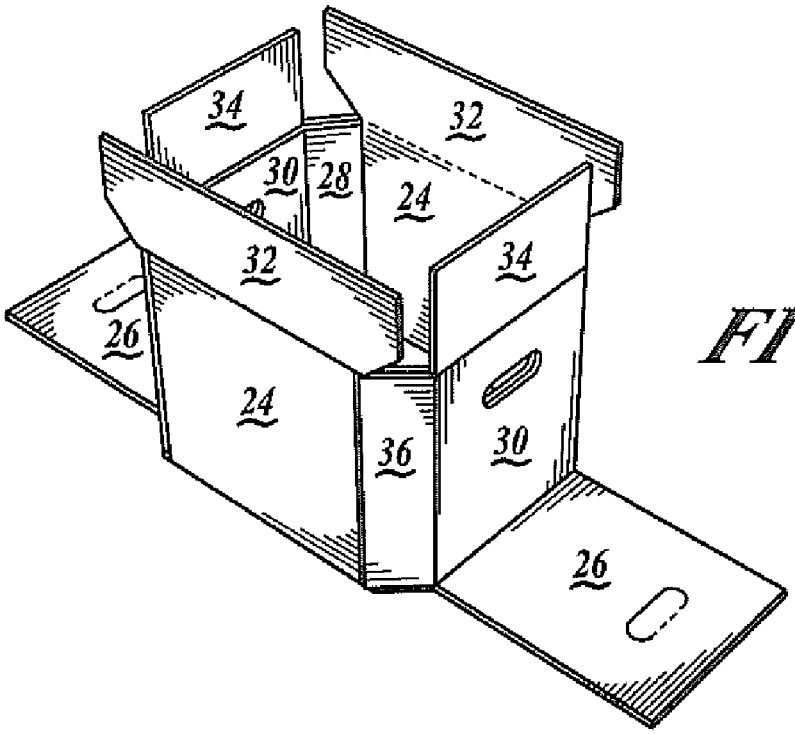
FIG. 4 is another, more fully assembled container based upon the blank of FIG. 1.

Subsequently, the opposed second sidewall configuration can be folded around in a similar manner such that a third side panel 28 of one sidewall configuration is juxtaposed a fifth sidewall 36 of the other sidewall configuration. Likewise, respective side panels 30 are juxtaposed to one another. This stage of container 42 erection is best depicted in FIG. 4.

Figure 5:
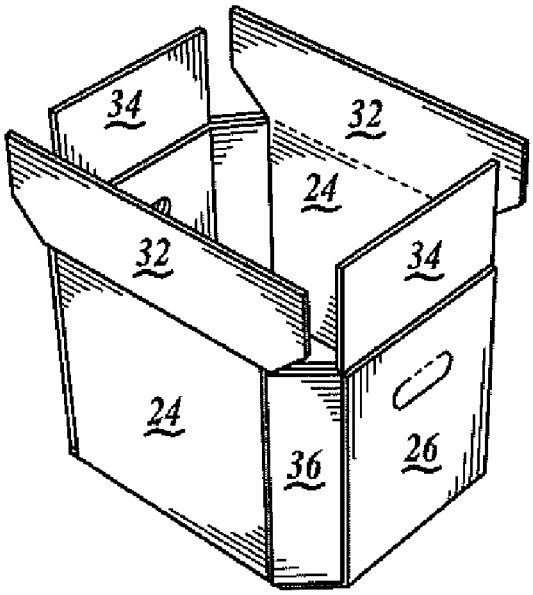
FIG. 5 is another, more fully assembled container based upon the blank of FIG. 1.

The erection of the container may further be completed by folding the second side panels 26 upwardly approximately 90 degrees along fold line 23. At this stage of erection, the second side panel is juxtaposed the dual thickness of juxtaposed fourth side panels 30, giving this region of the container a triple wall thickness. Also, the container 42 includes double wall thickness in the region of third side panels 28 and fifth side panel juxtaposition. Side panels 24 are single wall thickness. As best seen in FIG. 5, the container at this stage of erection is now ready to receive product (not shown).

Figure 6:
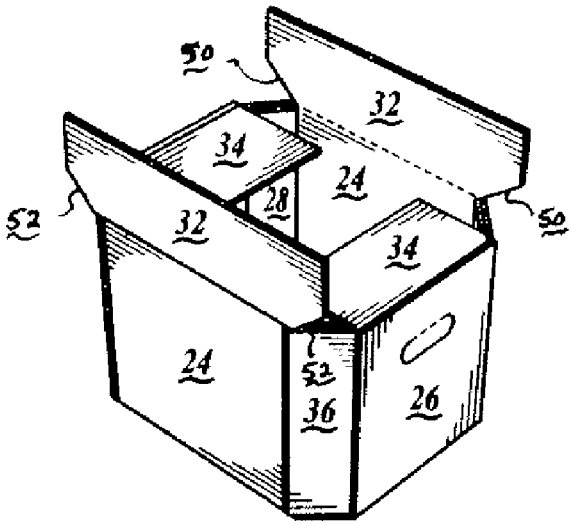
FIG. 6 is another, more fully assembled container based upon the blank of FIG. 1.
Figure 7:
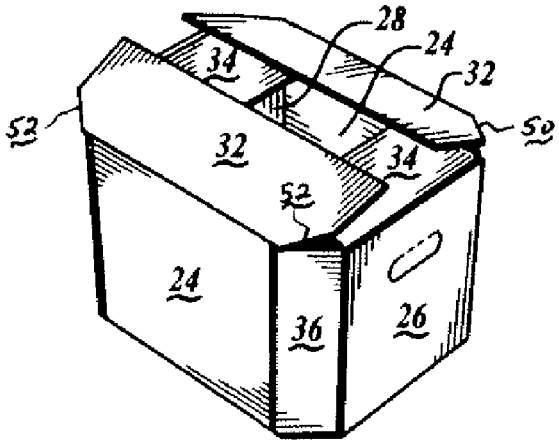
FIG. 7 is another, more fully assembled container based upon the blank of FIG. 1.
Figure 8:
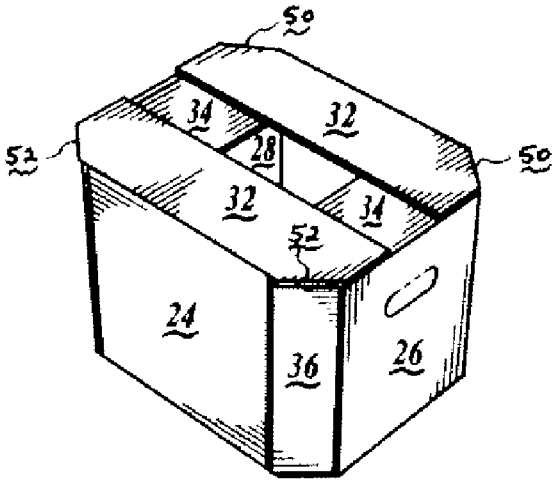
FIG. 8 is a fully erected container constructed from the blank depicted in FIG. 1.

FIGS. 6 and 7 depict the folding sequence of the various top panels. Specifically, the second top panel 34 may be folded inwardly approximately 90 degrees along a fold line 33. Subsequently, the first top panel 32 may be folded inwardly approximately 90 degrees along fold line 33. This results in a fully erected and closed container 42. Referring to FIGS. 1 and 6-8, the first top panel 32 includes a pair of mitered edge 50 and the second top panel 32 includes a pair of mitered edge 52 which extend outward to the point that they rest upon and aligned with the respective upper edge of each panel 36.

Figure 9:
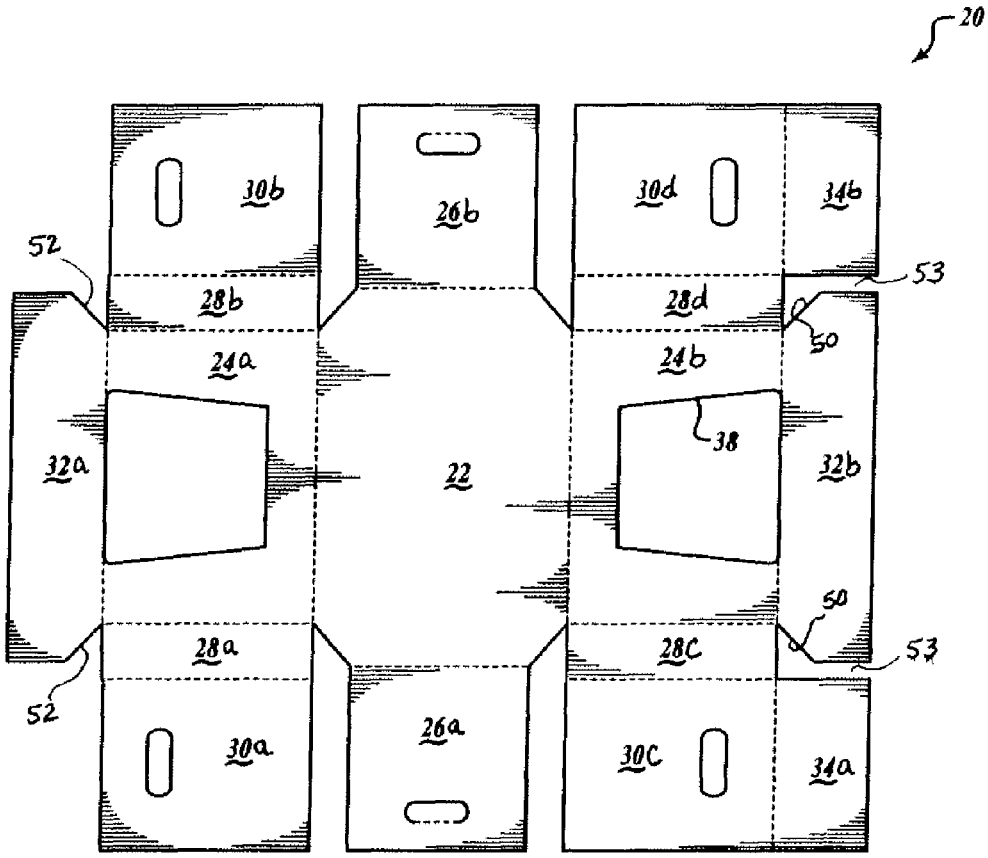
FIG. 9 is another plan view of an exemplary container blank formed in accordance of another aspect of the present invention.
Figure 10:
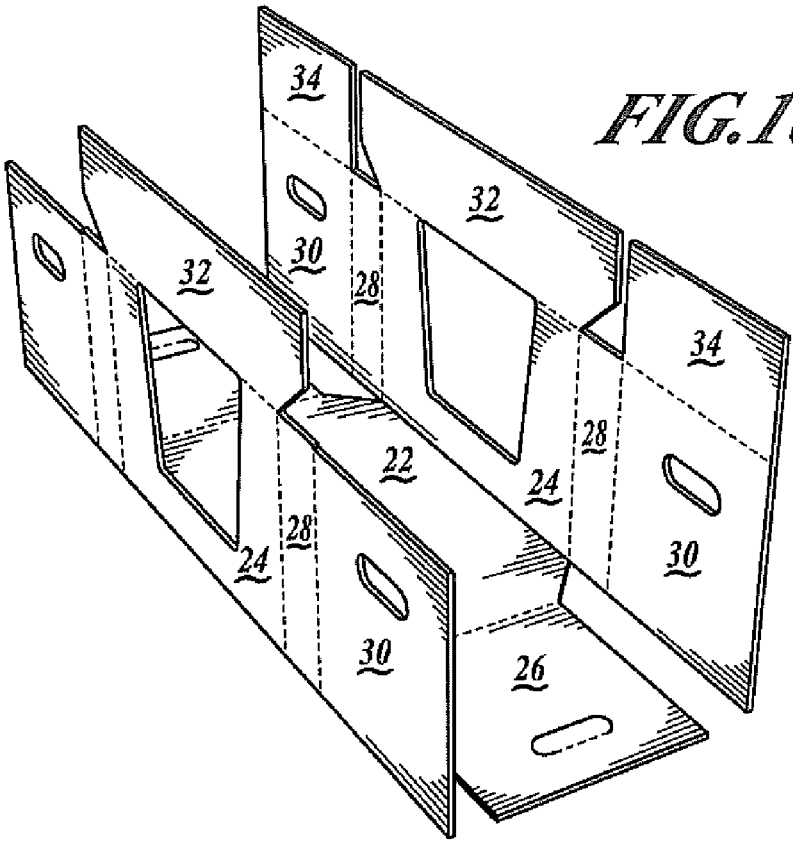
FIG. 10 is a perspective view of a partially assembled container based on the blank of FIG. 9.
Figure 11:
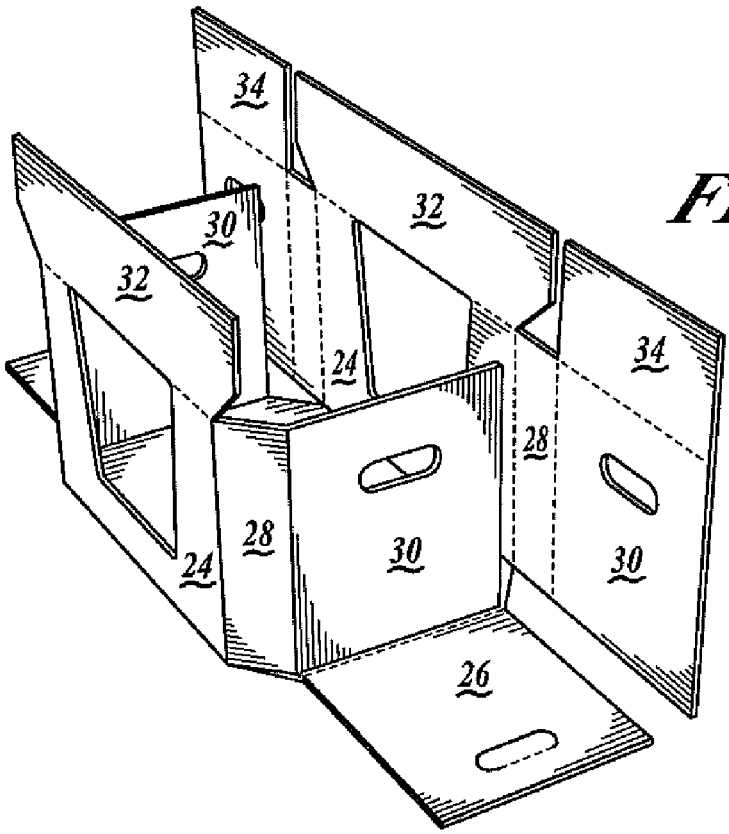
FIG. 11 is another, more fully assembled container based upon the blank of FIG. 9.
Figure 12:
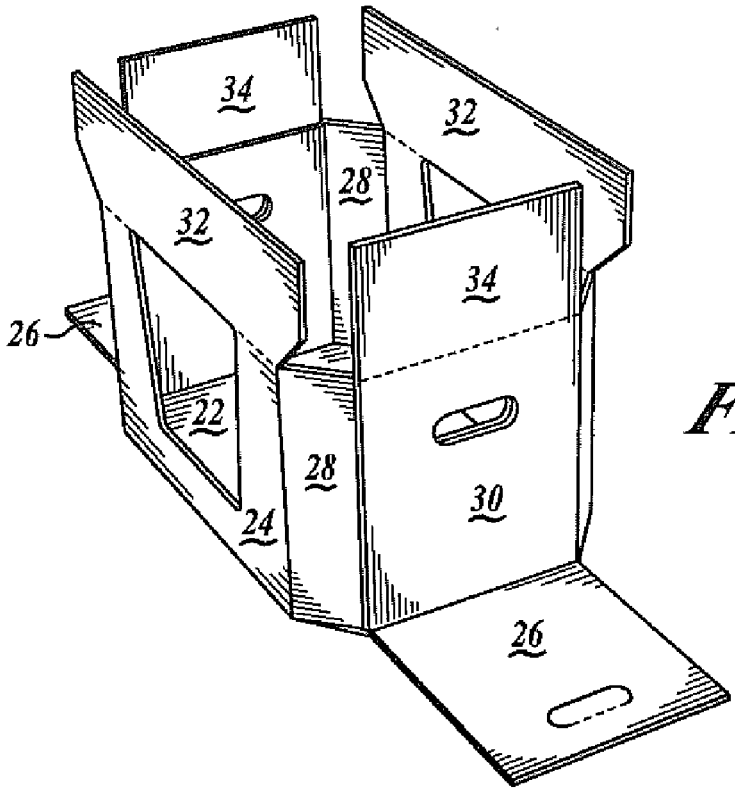
FIG. 12 is another, more fully assembled container based upon the blank of FIG. 9.
Figure 13:
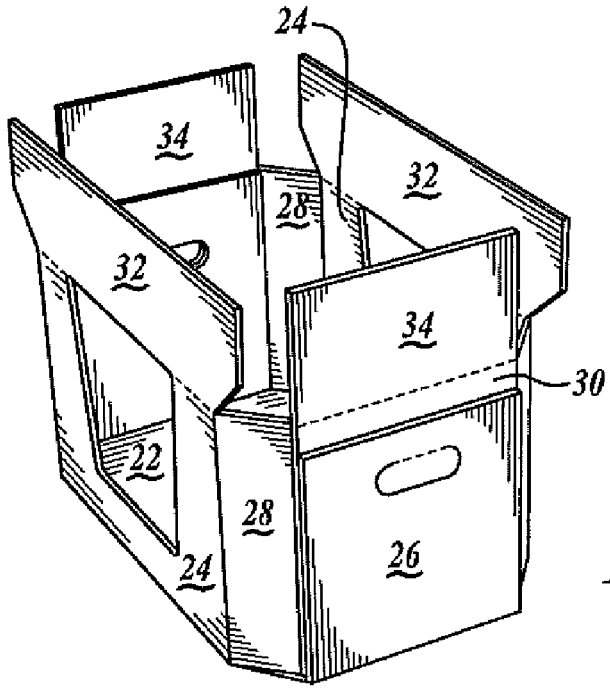
FIG. 13 is another, more fully assembled container based upon the blank of FIG. 9.
Figure 14:
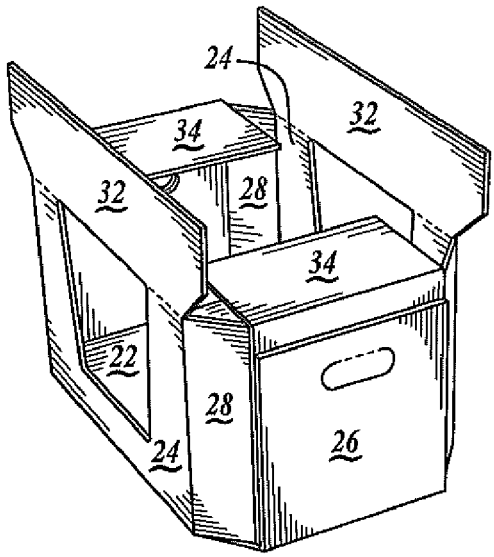
FIG. 14 is another, more fully assembled container based upon the blank of FIG. 9.
Figure 15:
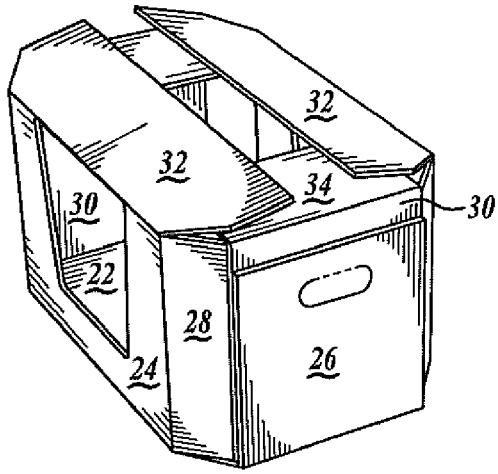
FIG. 15 is another, more fully assembled container based upon the blank of FIG. 9.
Figure 16:
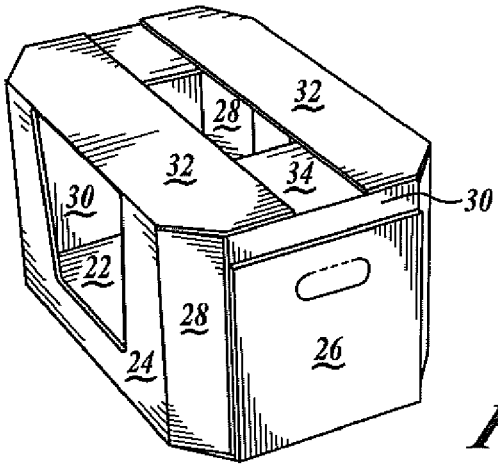
FIG. 16 is a fully erected container constructed from the blank depicted in FIG. 9.
Figure 17:
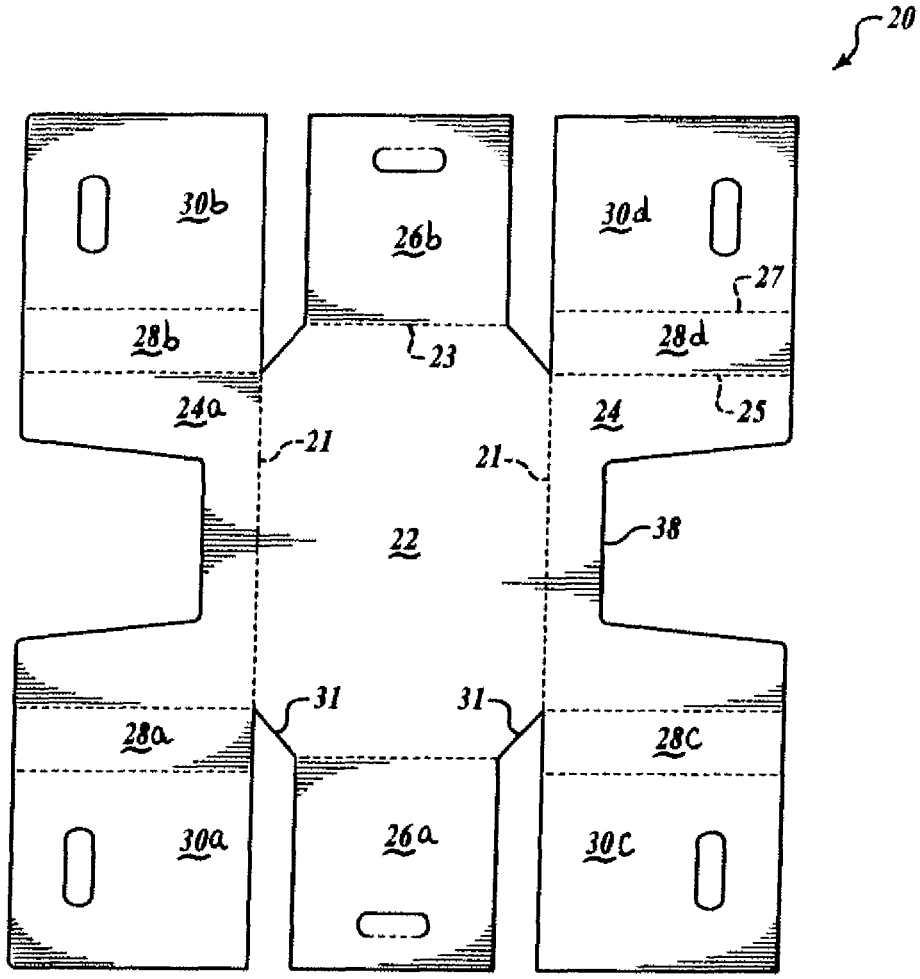
FIG. 17 is yet another plan view of an exemplary container blank formed in accordance of another aspect of the present invention.
Figure 18:
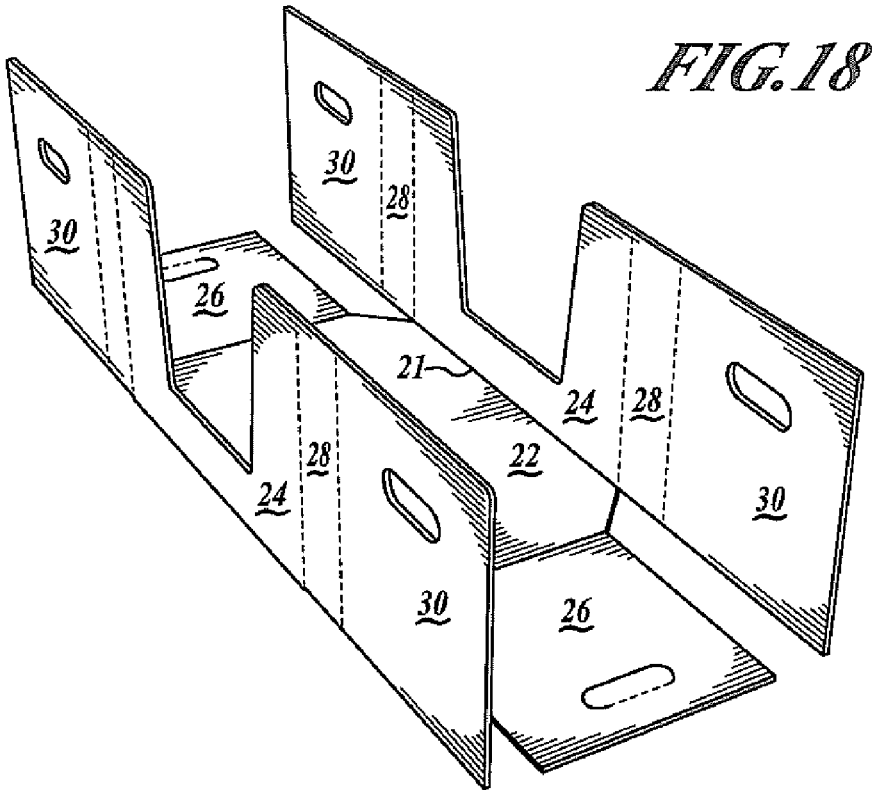
FIG. 18 is a partially assembled container made from the container blank of FIG. 17.
Figure 19:
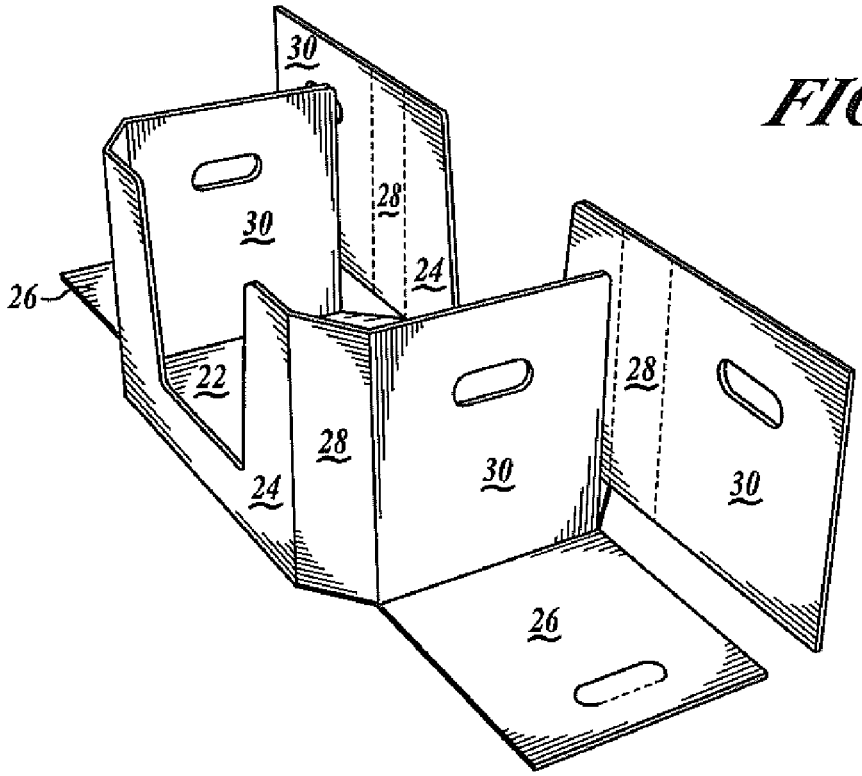
FIG. 19 is yet another partially assembled container made from the container blank of FIG. 17.
Figure 20:
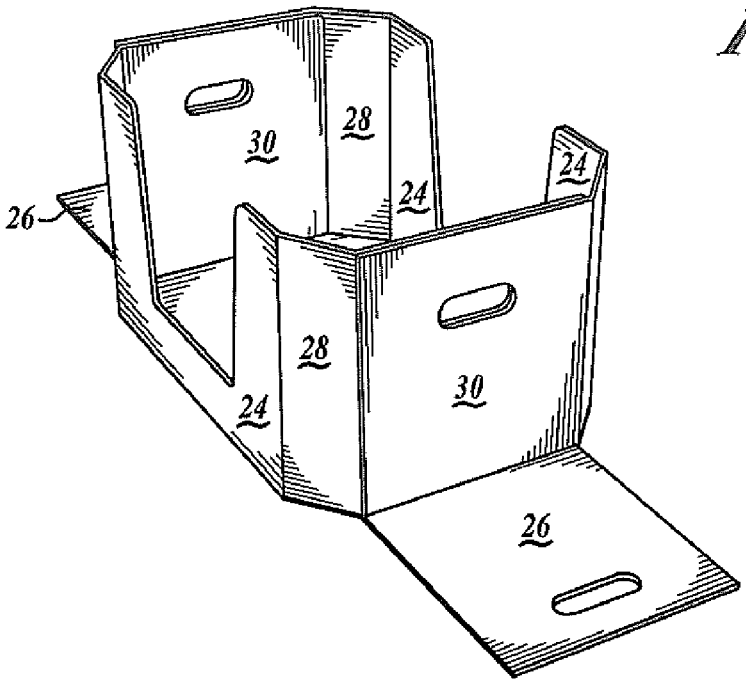
FIG. 20 is yet another partially assembled container made from the container blank of FIG. 17.
Figure 21:
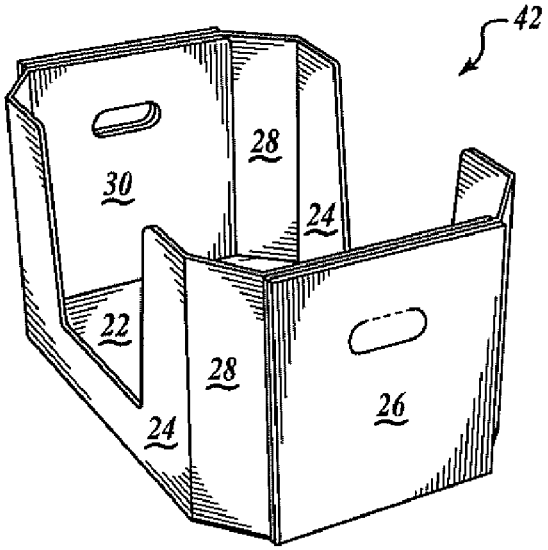
FIG. 21 is the fully assembled container made from the blank of FIG. 17.

An alternative embodiment of the blank 20 depicted in FIG. 1 is the blank 20 depicted in FIG. 9. This embodiment is typically a display and shipping container. This blank 20 configuration is substantially the same as the embodiment depicted in FIG. 1, with just a few modifications. Specifically, this blank 20 is shown as not depicting a fifth side panel 36; however, it will be appreciated the fifth side panel 36 may be included if it is so desired. Likewise, the embodiment depicted in FIG. 9 includes a cut-out 38 formed in the first side panel 24. The geometry of the cut-out 38 is not intended to be limiting, nor must the cut-out 38 be formed in both first side panels 24 (not shown). Cut-out 38 allows viewing or access to the product that is ultimately stored within the container 42.

It will also be appreciated that cut-out 38 may not be cut-out of the blank 20 during the blank 20 forming process. Rather, the cut-out 38 may be formed by a perforation line such that a user may remove the defined cut-out region as desired. Until such time, the perforated, but yet still present cut-out 38 will keep the interior of the container 42 clean while still providing some structural advantage.

The folding sequences of this particular embodiment are substantially the same as those discussed above, and are depicted in FIGS. 10-16. As the sequence is generally discussed above, and is fully shown in the FIGURES, it is not required to discuss such here in order to fully understand the invention. The container 42 resulting from this embodiment includes a closed container with viewing and user access through the first side panels 24. It will be appreciated that in this model, should it be desired to have a fifth side panel 36, a person could do so without departing from the spirit and scope of this invention.

Still another embodiment of the present invention is depicted in FIGS. 17 through 21. This embodiment depicts more of the display container aspects of the present invention. This embodiment, like that depicted in FIGS. 9-16, does not include the fifth sidewall panels 36. Additionally, the cut-out 38 is shown in the second side panel 24. It will be appreciated, however, that this container may include the addition of the fifth side panel 24 and it may include the absence of cut-out 38 without departing from the spirit and scope of this invention. A further difference in this embodiment is the lack of first top panel 32 and second top panel 34. In this particular embodiment, the container 42 that is formed is fully open at the top and therefore does not include the associated top panels.

The erection sequences depicted in FIGS. 18 through 21 are substantially the same as those described above, with the exclusion of folding over the top panels. As such, a detailed discussion of the sequence is not required herein to understand the invention.

In summation, the present invention is an octagonal shipping and display container having a bottom wall 22, opposed parallel sidewalls 24, opposed parallel end walls 26, and diagonal corner panels 28. In a preferred form of the invention opposed top wall panels are foldably joined to upper edges of the sidewalls and end walls. The container is made from a single unitary sheet of cut and scored foldable material.

The bottom wall is octagonally shaped with opposed parallel side edges (21*a*, 21*b*), opposed parallel end edges (23*a*, 23*b*) extending perpendicular to the side edges, and mitered corners (25*a*, 25*b*, 25*c*, 25*d*) connecting respective adjacent ends of the side and end edges.

First and second substantially identical opposed parallel sidewall panels (24*a*, 24*b*) are foldably joined to respective opposite side edges of the bottom wall panel, and first and second substantially identical opposed parallel outer end wall panels (26*a*, 26*b*) are foldably joined to respective opposite end edges of the bottom wall panel.

First and second diagonal corner panels (28*a*, 28*b*) are foldably connected along respective first edges thereof to respective opposite side edges of the first sidewall panel (24*a*), and third and fourth diagonal corner panels (28*c*, 28*d*) are foldably connected along respective first edges thereof to respective opposite side edges of the second sidewall panel (24*b*). A bottom edge of each diagonal corner panel coincides with a respective mitered corner of the bottom wall panel.

First and second substantially identical inner end wall panels (30*a*, 30*b*) are foldably joined along one side edge thereof, respectively, to a respective second edge of the first and second diagonal corner panels, and first and second substantially identical intermediate end wall panels (30*c*, 30*d*) are foldably joined along one side edge thereof, respectively, to a respective second edge of each of the third and fourth diagonal corner panels. The intermediate end wall panels are sandwiched between the inner and outer end wall panels to form triple thickness end walls.

First and second inwardly folded rectangularly shaped inner top wall panels (34*a*, 34*b*) are foldably joined to respective top edges of the first and second intermediate end wall panels (30*c*, 30*d*), and first and second inwardly folded hexagonally shaped outer top wall panels (32*a*, 32*b*) are foldably joined to a top edge of respective sidewall panels (24*a*, 24*b*).

In accordance with that form of the invention shown in FIG. 1, a fifth diagonal corner panel (36*a*) is foldably connected to a side edge of the first inner end wall panel (30*a*) opposite the edge connected with the first diagonal corner panel (28*a*), and a sixth diagonal corner panel (36*b*) is foldably connected to a side edge of the second inner end wall panel (30*b*) opposite the edge connected with the second diagonal corner panel (28*b*). A seventh diagonal corner panel (36*c*) is foldably connected to a side edge of the first intermediate end wall panel (30*c*) opposite the edge connected with the third diagonal corner panel (28*c*), and an eighth diagonal corner panel (36*d*) is foldably connected to a side edge of the second intermediate end wall panel (30*d*) opposite the edge connected with the fourth diagonal corner panel (28*d*). The seventh diagonal corner panel (36*c*) overlies said first diagonal corner panel (28*a*), the third diagonal corner panel (28*c*) overlies the fifth diagonal corner panel (36*a*), the fourth diagonal corner panel (28*d*) overlies the sixth diagonal corner panel (36*b*), and the eighth diagonal corner panel overlies the second diagonal corner panel (28*b*), thereby forming double thickness diagonal corner panels.

In those forms of the invention shown in FIGS. 1 and 9, it will be observed that the minor inner top panels (34*a*, 34*b*) and one of the major outer top panels (32*b*) are on the same end of the blank, with a cut out slot between adjacent edges thereof.

While various embodiments of this invention have been illustrated and described as noted above, many changes can be made without departing from the spirit and scope of the invention. Accordingly, the scope of the invention is not limited by the disclosure of the various embodiments. Instead, the invention should be determined entirely by reference to the claims that follow.

What is claimed is:

1. A shipping and display container having a bottom wall, opposed parallel sidewalls, opposed parallel end walls, and diagonal corner panels, wherein said container is made from a single unitary sheet of cut and scored foldable material, and wherein:

said bottom wall comprises an octagonally shaped bottom wall panel (22) having opposed parallel side edges (21*a*, 21*b*), opposed parallel end edges (23*a*, 23*b*) extending perpendicular to the side edges, and mitered corners (25*a*, 25*b*, 25*c*, 25*d*) connecting respective adjacent ends of the side and end edges;

first and second substantially identical opposed parallel sidewall panels (24*a*, 24*b*) are foldably joined to respective opposite said side edges of the bottom wall panel;

first and second substantially identical opposed parallel outer end wall panels (26*a*, 26*b*) are foldably joined to respective opposite said end edges of the bottom wall panel;

first and second diagonal corner panels (28*a*, 28*b*) are foldably connected along respective first edges thereof to respective opposite side edges of said first sidewall panel (24*a*), and third and fourth diagonal corner panels (28*c*, 28*d*) are foldably connected along respective first edges thereof to respective opposite side edges of said second sidewall panel (24*b*), a bottom edge of each said diagonal corner panel coinciding with a respective said mitered corner of said bottom wall panel;

first and second substantially identical inner end wall panels (30*a*, 30*b*) are foldably joined along one side edge thereof, respectively, to a respective second edge of said first and second diagonal corner panels;

first and second substantially identical intermediate end wall panels (30*c*, 30*d*) are foldably joined along one side edge thereof, respectively, to a respective second edge of each of said third and fourth diagonal corner panels, said intermediate end wall panels being sandwiched between said inner and outer end wall panels to form triple thickness end walls;

first and second inwardly folded rectangularly shaped inner top wall panels (34*a*, 34*b*) are foldably joined to a top edge of respective said first and second intermediate end wall panels (30*c*, 30*d*); and first and second inwardly folded hexagonally shaped outer top wall panels (32*a*, 32*b*) are foldably joined to a top edge of respective said sidewall panels (24*a*, 24*b*).

2. The container of claim 1, wherein the single sheet of foldable material is formed from a cellulose-based material.

3. The container of claim 1, wherein the cellulose based material is formed from at least one of a wood pulp, straw, cotton, and bagasse.

4. The container of claim blank 1, wherein the cellulose based material is in the form of at least one of a fiberboard, containerboard, corrugated containerboard and paperboard.

5. A shipping and display container as claimed in claim 1, wherein:

a fifth diagonal corner panel (36*a*) is foldably connected to a side edge of said first inner end wall panel (30*a*) opposite the edge connected with the first diagonal corner panel (28*a*);

a sixth diagonal corner panel (36*b*) is foldably connected to a side edge of said second inner end wall panel (30*b*) opposite the edge connected with the second diagonal corner panel (28*b*);

a seventh diagonal corner panel (36*c*) is foldably connected to a side edge of said first intermediate end wall panel (30*c*) opposite the edge connected with the third diagonal corner panel (28*c*);

an eighth diagonal corner panel (36*d*) is foldably connected to a side edge of said second intermediate end wall panel (30*d*) opposite the edge connected with the fourth diagonal corner panel (28*d*); and wherein said seventh diagonal corner panel (36*e*) overlies said first diagonal corner panel (28*a*), said third diagonal corner panel (28*c*) overlies said fifth diagonal corner panel (36*a*), said fourth diagonal corner panel (28*d*) overlies said sixth diagonal corner panel (36*b*), and said eighth diagonal corner panel overlies said second diagonal corner panel (28*b*), thereby forming double thickness diagonal corner panels.

6. The container of claim 5, wherein the single sheet of foldable material is formed from a cellulose-based material.

7. The container of claim 6, wherein the cellulose based material is formed from at least one of a wood pulp, straw, cotton, and bagasse.

8. The container of claim 6, wherein the cellulose based material is in the form of at least one of a fiberboard, containerboard, corrugated containerboard and paperboard.

9. The container of claim 5, wherein aligned hand hold openings (40) are formed through said inner (30*a*, 30*b*), intermediate (30*c*, 30*d*) and outer (26*a*, 26*b*) end wall panels.

10. A one-piece unitary blank of foldable material cut and scored to form a container having an octagonally shaped bottom wall, opposite parallel sidewalk, opposite parallel end walls, and diagonal corner panels joining opposite ends of adjacent sidewalk and end walls, said blank comprising:

an octagonally shaped bottom wall panel (22) having opposed parallel side edges (21*a*, 21*b*), opposed parallel end edges (23*a*, 23*b*) extending perpendicular to the side edges, and mitered corners (25*a*, 25*b*, 25*c*, 25*d*) connecting respective adjacent ends of the side and end edges;

first and second substantially identical opposed sidewall panels (24*a*, 24*b*) foldably joined to respective opposite said side edges of the bottom wall panel;

first and second substantially identical opposed outer end wall panels (26*a*, 26*b*) foldably joined to respective opposite said end edges of the bottom wall panel;

first and second diagonal corner panels (28*a*, 28*b*) foldably connected along respective first edges thereof to respective opposite side edges of said first sidewall panel (24*a*), and third and fourth diagonal corner panels (28*c*, 28*d*) foldably connected along respective first edges thereof to respective opposite side edges of said second sidewall panel (24*b*);

first and second substantially identical inner end wall panels (30*a*, 30*b*) foldably joined along one side edge thereof, respectively, to an edge of said first and second diagonal corner panels opposite said first edge;

first and second substantially identical intermediate end wall panels (30*c*, 30*d*) foldably joined along one side edge thereof, respectively, to an edge of each of said third and fourth diagonal corner panels opposite said first edge;

first and second rectangularly shaped inner top wall panels (34*a*, 34*b*) foldably joined to an edge of respective said first and second intermediate end wall panels (30*c*, 30*d*) that forms a top edge in a container erected from the blank; and first and second hexagonally shaped outer top wall panels (32*a*, 32*b*) foldably joined to an edge of respective said sidewall panels (24*a*, 24*b*) that forms a top edge in a container erected from the blank, whereby said inner top wall panels and one of said outer top wall panels are on the same end of the blank.

11. A blank as claimed in claim 10, wherein:

a fifth diagonal corner panel (36*a*) is foldably connected to a side edge of said first inner end wall panel (30*a*) opposite the edge connected with the first diagonal corner panel (28*a*);

a sixth diagonal corner panel (36*b*) is foldably connected to a side edge of said second inner end wall panel (30*b*) opposite the edge connected with the second diagonal corner panel (28*b*);

a seventh diagonal corner panel (36*c*) is foldably connected to a side edge of said first intermediate end wall panel (30*c*) opposite the edge connected with the third diagonal corner panel (28*c*); and an eighth diagonal corner panel (36*d*) is foldably connected to a side edge of said second intermediate end wall panel (30*d*) opposite the edge connected with the fourth diagonal corner panel (28*d*).

12. A blank as claimed in claim 10, wherein:

a major portion of said first and second sidewall panels (24*a*, 24*b*) is cut away from adjacent the edge joined to the bottom wall panel through opposite edge thereof that forms the top edge in a container erected from the blank, forming large openings (38) through which articles in a container erected from the blank may be viewed and accessed.

13. A blank as claimed in claim 12, wherein:

aligned hand hold openings (40) are formed through said inner (30*a*, 30*b*), intermediate (30*c*, 30*d*) and outer (26*a*, 26*b*) end wall panels.

14. A blank as claimed in claim 10, wherein:

said inner and outer top wall panels are separated from one another at adjacent edges by a slot (50).

* * * * *